US007341504B1

(12) United States Patent
Chen

(10) Patent No.: US 7,341,504 B1
(45) Date of Patent: Mar. 11, 2008

(54) ADJUSTABLE SAND BLASTING GUN

(76) Inventor: Kuo-Liang Chen, No. 246-1, Changma Rd., Changhua (TW)

( * ) Notice: Subject to any disclaimer, the term of this patent is extended or adjusted under 35 U.S.C. 154(b) by 0 days.

(21) Appl. No.: 11/655,397

(22) Filed: Jan. 19, 2007

(51) Int. Cl.
*B24C 3/00* (2006.01)

(52) U.S. Cl. ..... 451/90; 451/102; 239/375; 239/526

(58) Field of Classification Search ..... 451/90, 451/101, 102; 239/375, 526
See application file for complete search history.

(56) References Cited

U.S. PATENT DOCUMENTS 2,526,403 A * 10/1950 Paasche ..... 451/90
2,577,465 A * 12/1951 Jones et al. ..... 451/90
3,055,149 A * 9/1962 Luce ..... 451/91
3,276,168 A * 10/1966 Ashworth ..... 451/90
3,624,966 A * 12/1971 Palmer ..... 451/90
4,674,239 A * 6/1987 Jodoin ..... 451/87
6,383,062 B1 * 5/2002 Jou ..... 451/90
6,702,203 B2 * 3/2004 Jou ..... 239/346

* cited by examiner

*Primary Examiner*—Eileen P. Morgan
(74) *Attorney, Agent, or Firm*—Jackson Walker, LLP

(57) ABSTRACT

An adjustable sand blasting gun has a body, a sand inlet and an adjusting device. The body has a chamber, a blasting head, a mounting tube and a connecting pipe. The blasting head is attached to the body and communicates with the chamber. The mounting tube is formed on the body. The connecting pipe is formed on and laterally extends from the mounting tube. The sand inlet is attached to the mounting tube and has a passage and a through hole. The passage is formed through the sand inlet and communicates with the chamber. The through hole is formed through the sand inlet and communicates with the connecting pipe. The adjusting device is connected to the body and the sand inlet and has an adjusting post and a mounting pin. The adjusting post is connected to the connecting pipe and the sand inlet. The mounting pin is connected to the adjusting post.

11 Claims, 4 Drawing Sheets

ADJUSTABLE SAND BLASTING GUN

BACKGROUND OF THE INVENTION

1. Field of the Invention

The present invention relates to a sand blasting gun, and more particularly to an adjustable sand blasting gun that can adjust and control the flow rate of sand easily and quickly.

2. Description of Related Art

Generally, conventional sand blasting guns are used to blast sand on surfaces of metals with compressed air to remove dust or water from the surfaces of the metals that may damage and rust the surfaces.

However, the flow rate of sand of the conventional sand blasting gun is constant. When users use the conventional sand blasting gun to blast onto metal that has a small surface. Users cannot adjust or control the flow rate of sand because the flow rate of sand of the conventional sand blasting gun is constant. By the way, users may blast too much sand on the small surface of the metal and waste sand. This will increase the cost of using the conventional sand blasting gun.

The adjustable sand blasting gun in accordance with the present invention mitigates or obviates the aforementioned problems.

SUMMARY OF THE INVENTION

The main objective of the present invention is to provide an adjustable sand blasting gun that can adjust and control the flow rate of sand easily and quickly.

The adjustable sand blasting gun has a body, a sand inlet and an adjusting device. The body has a chamber, a blasting head, a mounting tube and a connecting pipe. The blasting head is attached to the body and communicates with the chamber. The mounting tube is formed on the body. The connecting pipe is formed on and laterally extends from the mounting tube. The sand inlet is attached to the mounting tube and has a passage and a through hole. The passage is formed through the sand inlet and communicates with the chamber. The through hole is formed through the sand inlet and communicates with the connecting pipe. The adjusting device is connected to the body and the sand inlet and has an adjusting post and a mounting pin. The adjusting post is connected to the connecting pipe and the sand inlet. The mounting pin is connected to the adjusting post Other objectives, advantages and novel features of the invention will become more apparent from the following detailed description when taken in conjunction with the accompanying drawings.

DETAILED DESCRIPTION OF THE PREFERRED EMBODIMENT

Figure 1:
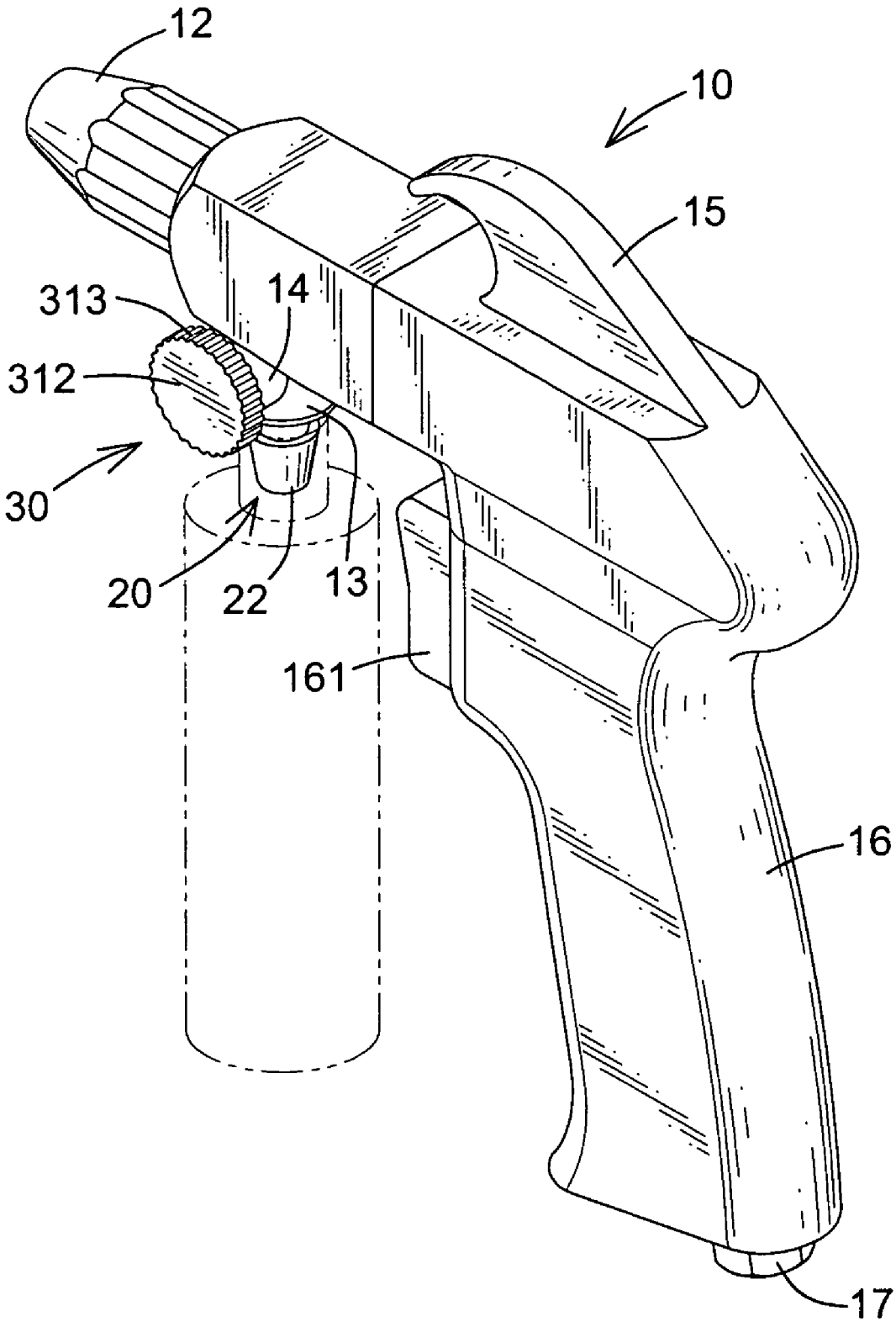
FIG. 1 is a perspective view of an adjustable sand blasting gun with a sand tank in accordance with the present invention.
Figures 2, 2A:
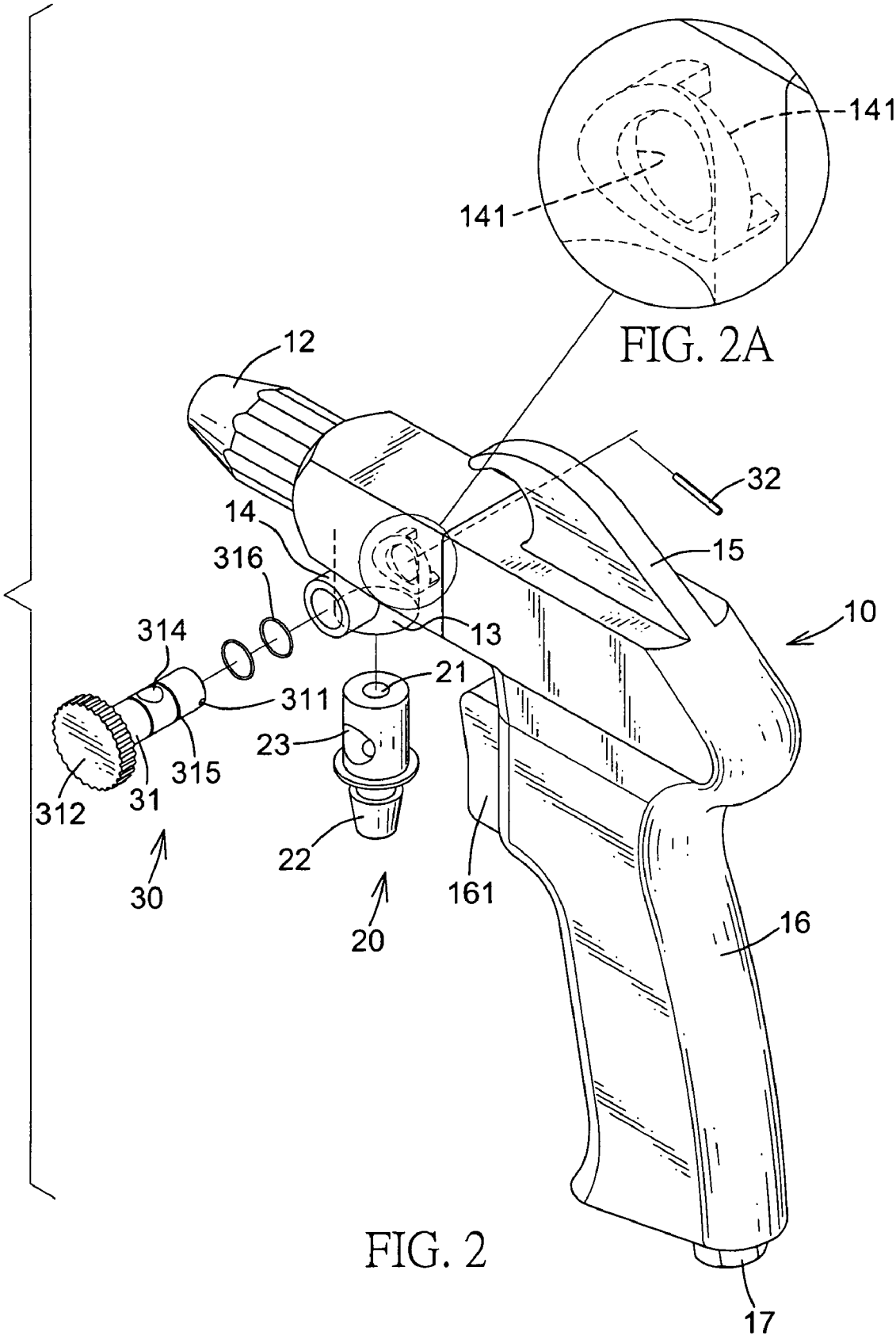
FIG. 2 is an exploded perspective view of the adjustable sand blasting gun in FIG. 1.
FIG. 2A is an enlarged perspective view of the restricting recesses of the body in FIG. 1.
Figure 3:
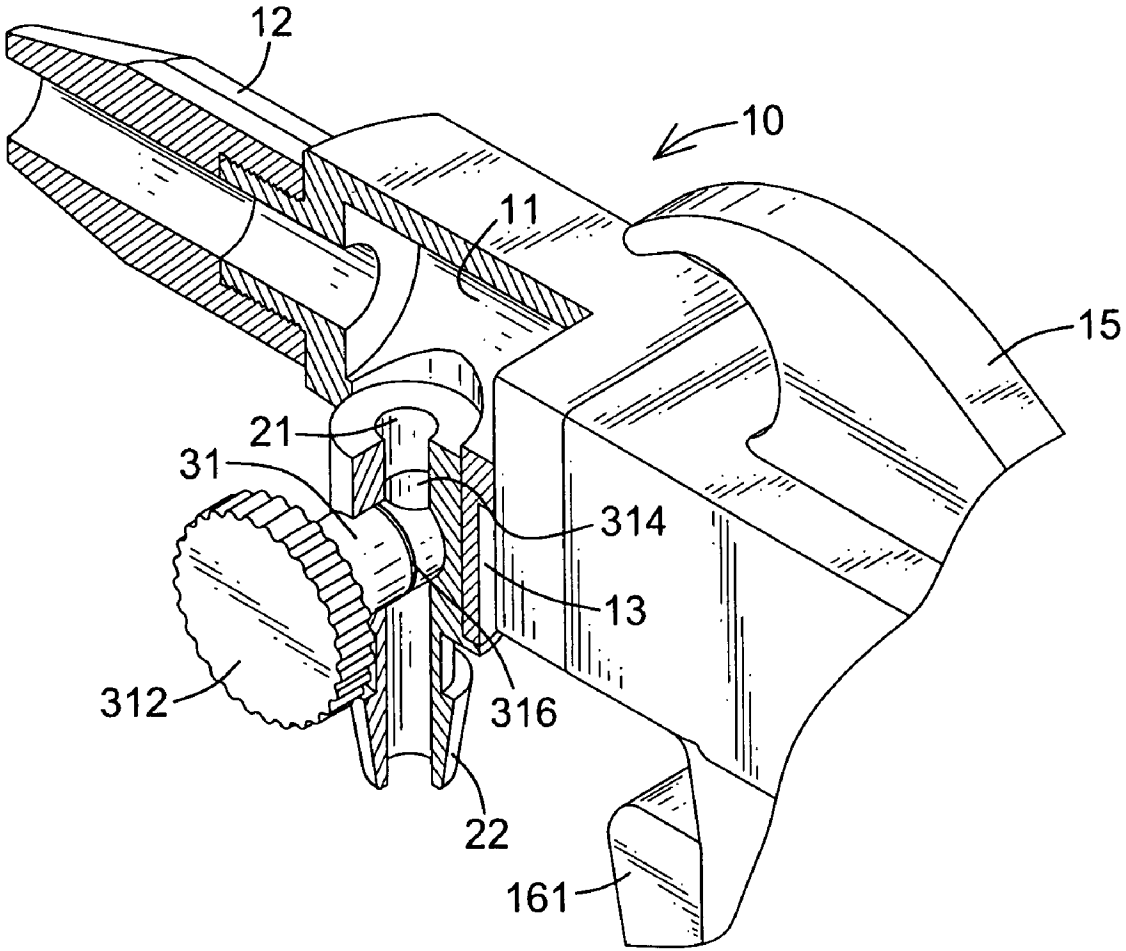
FIG. 3 is an enlarged perspective view in partial section of the adjustable sand blasting gun in FIG. 1.

With reference to FIGS. 1 to 3, an adjustable sand blasting gun in accordance with the present invention comprises a body (10), a sand inlet (20) and an adjusting device (30).

The body (10) is gun shaped and has a front end, a middle, a top, a bottom, a rear end, a chamber (11), a blasting head (12), a mounting tube (13), a connecting pipe (14), a hook (15), a handle (16) and a connector (17).

The chamber (11) is defined inside the body (10). The blasting head (12) is conical, is attached securely to the front end of the body (10) and is communicated with the chamber (11). The mounting tube (13) is formed on the bottom of the body (10) near the front end, is communicated with the chamber (11) of the body (10) and has a mounting end. The connecting pipe (14) is formed on and laterally extends from the mounting tube (13) near the mounting end of the mounting tube (13) and below the front end of the body (10) and has a proximal end, a distal end and two restricting recesses (141). With reference to FIGS. 2 and 2A, the restricting recesses (141) are formed in the distal end of the connecting pipe (14).

The hook (15) is formed on the top of the body (10) between the front end and the rear end. The handle (16) is formed on the bottom at the rear end of the body (10) and has a front side, a lower end, a passage communicating with the chamber (11) and a button (161). The button (161) is attached to the front side of the handle (16). The connector (17) is mounted on the lower end of the handle (16), and connects to a compressor via a hose. When the button (161) is pressed, the compressed air flows out from the compressor into the chamber (11) of the body (10) through the passage and discharges from the blasting head (12).

The sand inlet (20) is attached detachably to the mounting tube (13) of the body (10), connects with a sand tank and has an upper end, a lower end, a passage (21), a mounting head (22) and a through hole (23).

The upper end of the sand inlet (20) is connected securely to the mounting end of the mounting tube (13). The passage (21) is formed axially through the sand inlet (20) from the upper end to the lower end and communicates with the chamber (11) in the body (10). The mounting head (22) is formed on the lower end of the sand inlet (20) and connects with the sand tank. Then, sand in the sand tank can be led into the chamber (11) through the sand inlet (20) and the mounting tube (13) and is discharged from the blasting head (12) with the compressed air form the compressor. The through hole (23) is formed radially through the sand inlet (20) between the upper end and the lower end and is communicated with the connecting pipe (14).

The adjusting device (30) is connected rotatably to the body (10) and the sand inlet (20) and has an adjusting post (31) and a mounting pin (32).

The adjusting post (31) is connected to the connecting pipe (14) and the sand inlet (20) and has a free end, an operating end, a connecting hole (311), a rotating button (312), a nick (313), an adjusting hole (314), two annular grooves (315) and two O-rings (316).

The free end of the adjusting post (31) extends into the connecting pipe (14) and through the through hole (23) of the sand inlet (20). The connecting hole (311) is formed radially through the free end of the adjusting post (31). The rotating button (312) is mounted on the operating end of the adjusting post (31), allows the adjusting post (31) to be rotated relative to the connecting pipe (14) and the sand inlet (20) and has a periphery. The nick (313) is formed on the periphery of the rotating button (312). The adjusting hole (314) is formed radially through the adjusting post (31) between the connecting hole (311) and the rotating button (312) and is communicated with the passage (21) in the sand inlet (20) and the chamber (11) in the body (10). The annular grooves (315) are formed around the adjusting post (31) respectively between the rotating button (312), the adjusting hole (314) and the connecting hole (311). The O-rings (316) are respectively mounted in the annular grooves (315) to prevent the compressed air and sand leaking from the conjunction between the adjusting post (31) and the connecting pipe (14). The mounting pin (32) is inserted to the connecting hole (311) in the adjusting post (31) and has two ends respectively held in the restricting recesses (141) in the connecting pipe (14).

Figure 4:
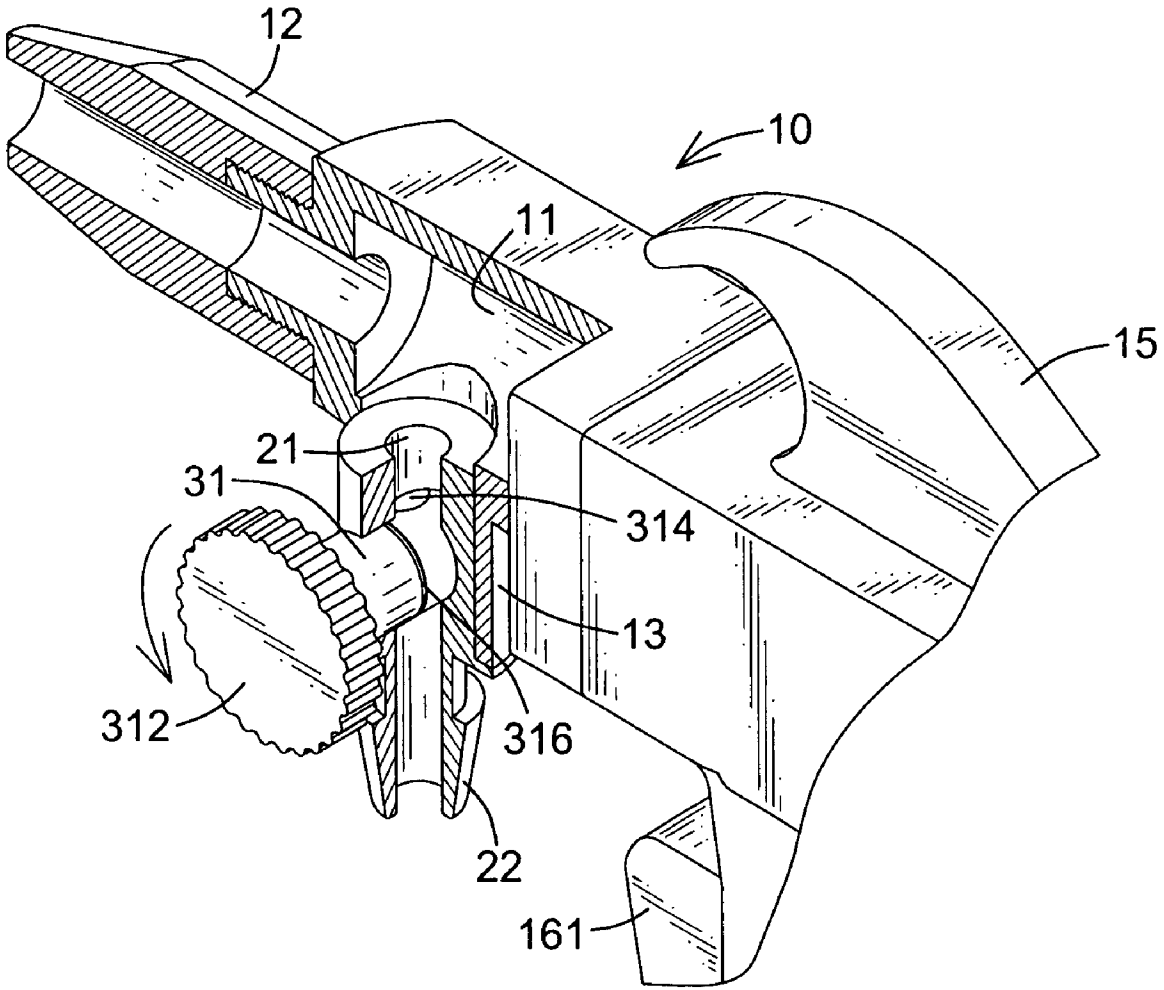
FIG. 4 is an operational perspective view of the adjustable sand blasting gun in FIG. 3.

With reference to FIGS. 1, 3 and 4, the compressed air flows into the body (10) through the hose of the compressor, the connector (17) and the passage in the handle (16) when the button (16) is pressed. Then, the compressed air flows into the blasting head (12) via the chamber (11). When the compressed air flows into the chamber (11) of the body (10), sand in the sand tank will be sucked to the blasting head (12) via the passage (21), the adjusting hole (314) and the chamber (11). When the rotating button (312) is rotated, the area of the adjusting hole (314) corresponding to and communicating with the passage (21) will be changed. Thus, the flow rate of sand in the sand tank is changed by rotating the rotating button (312) of the adjusting post (31). Accordingly, users can adjust and control the flow rate of sand by rotating the rotating button (312) easily and quickly.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable sand blasting gun having
- a body having
  - a front end;
  - a middle;
  - a top;
  - a bottom;
  - a rear end;
  - a chamber being defined inside the body;
  - a blasting head being attached securely to the front end of the body and communicating with the chamber for directing sand at a target;
  - a mounting tube being formed on the bottom of the body near the front end, being communicated with the chamber of the body and having a mounting end; and
  - a connecting pipe being formed on and laterally extends from the mounting tube near the mounting end of the mounting tube and below the front end of the body and having
    - a proximal end; and
    - a distal end;
- a sand inlet being attached detachable to the mounting tube of the body and having
  - an upper end being connected securely to the mounting end of the mounting tube;
  - a lower end;
  - a passage being formed axially through the sand inlet from the upper end to the lower end and being communicated with the chamber in the body; and
  - a through hole being formed radially through the sand inlet between the upper end and the lower end and being communicated with the connecting pipe; and
- an adjusting device being connected to the connecting pipe and the sand inlet and having
  - an adjusting post being connecting to the connecting pipe and the sand inlet and having
    - a free end extending into the connecting pipe and through the through hole of the sand inlet;
    - an operating end;
    - a connecting hole being formed radially through the free end of the adjusting post;
    - a rotating button being mounted on the operating end of the adjusting post for turning said adjusting post and having a periphery;
    - an adjusting hole being formed radially through the adjusting post between the connecting hole and the rotating button and being communicated with the passage in the sand inlet and the chamber in the body wherein the position of the adjusting hole determines the amount of sand passing therethrough; and
  - a mounting pin being inserted into the connecting hole in the adjusting post to guide the turning of the adjusting post.

2. The adjustable sand blasting gun as claimed in claim 1, wherein the body has
- a hook being formed on the top of the body; and
- a handle being formed on the bottom at the rear end of the body, being communicated with the chamber and having
  - a front side;
  - a lower end; and
  - a button being attached to the front side of the handle; and
  - a connector being mounted on the lower end of the handle.

3. The adjustable sand blasting gun as claimed in claim 1, wherein the adjusting post has
- two annular grooves being formed around the adjusting post respectively between the rotating button, the adjusting hole and the connecting hole; and
- two O-rings being respectively mounted in the annular grooves.

4. The adjustable sand blasting gun as claimed in claim 1, wherein the sand inlet has a mounting head being formed on the lower end of the sand inlet.

5. The adjustable sand blasting gun as claimed in claim 1, wherein the adjusting post has a nick being formed on the periphery of the rotating button.

6. The adjustable sand blasting gun as claimed in claim 1, wherein
- the body is gun shaped; and
- the blasting head is conical.

7. The adjustable sand blasting gun as claimed in claim 2, wherein the connecting pipe has two restricting recesses being formed in the distal end of the connecting pipe; and
- the mounting pin has two ends respectively held in the restricting recesses in the connecting pipe to adjust the position of the adjusting hole by limiting the turning of the adjusting post.

8. The adjustable sand blasting gun as claimed in claim 7, wherein the adjusting post has two annular grooves being formed around the adjusting post respectively between the rotating button, the adjusting hole and the connecting hole; and two O-rings being respectively mounted in the annular grooves.

9. The adjustable sand blasting gun as claimed in claim 8, wherein the sand inlet has a mounting head being formed on the lower end of the sand inlet.

10. The adjustable sand blasting gun as claimed in claim 9, wherein the adjusting post has a nick being formed on the periphery of the rotating button.

11. The adjustable sand blasting gun as claimed in claim 10, wherein the body is gun shaped; and the blasting head is conical.

* * * * *